US005918580A

United States Patent [19]

Hennrich et al.

[11] Patent Number: 5,918,580

[45] Date of Patent: Jul. 6, 1999

[54] FUEL TANK VENTING SYSTEM FOR A VEHICLE WITH AN INTERNAL COMBUSTION ENGINE

[75] Inventors: Werner Hennrich, Fellbach; Lothar Mauz, Esslingen; Henrik Weber, Weilersbach, all of Germany

[73] Assignee: Daimler-Benz AG, Stuttgart, Germany

[21] Appl. No.: 08/962,901

[22] Filed: Nov. 3, 1997

[30] Foreign Application Priority Data

Nov. 4, 1996 [DE] Germany ..... 196 45 382

[51] Int. Cl.[6] ..... F02M 33/04

[52] U.S. Cl. ..... 123/520; 123/516

[58] Field of Search ..... 123/516, 518, 123/519, 520, 198 D

[56] References Cited

U.S. PATENT DOCUMENTS

| | | | |
|---|---|---|---|
| 5,183,023 | 2/1993 | Hanson . | |
| 5,190,015 | 3/1993 | Nakata et al. | 123/519 |
| 5,220,898 | 6/1993 | Kidokoro et al. | 123/519 |
| 5,245,973 | 9/1993 | Otsuka et al. | 123/519 |
| 5,273,020 | 12/1993 | Hayami . | |
| 5,349,934 | 9/1994 | Miyano | 123/519 |
| 5,371,412 | 12/1994 | Iwashita et al. | 123/519 |
| 5,477,842 | 12/1995 | Maruyama et al. | 123/519 |
| 5,533,479 | 7/1996 | Wild et al. | 123/520 |
| 5,544,483 | 8/1996 | Heuer . | |

FOREIGN PATENT DOCUMENTS

| | | |
|---|---|---|
| 38 32 500 | 7/1989 | Germany . |
| 43 16 392 | 12/1993 | Germany . |
| 43 11 316 | 3/1994 | Germany . |
| 43 12 720 | 10/1994 | Germany . |

*Primary Examiner*—Thomas N. Moulis
*Attorney, Agent, or Firm*—Klaus J. Bach

[57] ABSTRACT

In a fuel tank venting system for a vehicle with an internal combustion engine having an air intake duct and an adsorption filter in which fuel vapors are adsorbed, a venting line extends from the adsorption filter to the air intake duct and includes a regeneration valve, and a bypass line is disposed in parallel with a section of the venting line and includes an air pump for pumping air from the adsorption filter to the air intake duct to provide for venting air flow particularly when the engine is operating under a high load where little vacuum is generated in the air intake duct.

10 Claims, 4 Drawing Sheets

FUEL TANK VENTING SYSTEM FOR A VEHICLE WITH AN INTERNAL COMBUSTION ENGINE

BACKGROUND OF THE INVENTION

The invention resides in a fuel tank venting system specifically, a tank venting system for a vehicle with an internal combustion engine, wherein an absorption filter is disposed in a tank connecting line and a vent line with a regeneration valve extends from the absorption to an air intake duct of the engine.

DE 43 12 720 A1 discloses a tank venting system for a vehicle with an internal combustion engine which includes a tank communication line leading from the tank to an adsorption filter and a tank venting line, which includes a regeneration valve, and extends from the adsorption filter to an engine intake duct. This internal combustion engine includes a charger whereby, dependent on the adjustment of the pressure control valves, an excess pressure can be generated in the adsorption filter and the adsorption filter can be vented such that the fuel vapors are supplied to the intake duct.

This tank venting system has the disadvantage that it can be used only in connection with vehicles having an internal combustion engine with a charger wherein a part of the charge air flow is conducted into the adsorption filter. In addition, it is necessary that the line leading to the adsorption filter as well as the venting line extending from the adsorption filter includes expensive pressure control valves which have to be controlled by means of a pressure valve control apparatus. The arrangement further requires an additional communication line between the charger and the adsorption filter.

Tank venting arrangements are also known wherein the adsorption filter is regenerated utilizing the vacuum in the engine intake duct. These venting arrangements are usually utilized in connection with internal combustion engines which have no turbocharger. However, they have the disadvantage that the vacuum and consequently the reconditioning of the adsorption filter depends on the position of the throttle valve, that is, on the engine power output.

Under full engine load, there is essentially no vacuum in the engine intake duct because there is no throttling. In the full load range, in which the engine could accommodate the largest regeneration flow without effects on the emission values, the vacuum required for the regeneration is not available! During idling, however, when there is greatest vacuum in the engine intake duct, only small amounts of fuel vapors can be accommodated by the engine without detrimental effect on emission values.

It is the object of the present invention to provide a tank venting system for motor vehicles with internal combustion engines wherein a regeneration air flow proportional to the air mass intake flow into the engine is provided in a simple manner.

SUMMARY OF THE INVENTION

In a fuel tank venting system for a vehicle with an internal combustion engine having an air intake duct and an adsorption filter in which fuel vapors are adsorbed, a venting line extends from the adsorption filter to the air intake duct and includes a regeneration valve. A bypass line is disposed in parallel with a section of the venting line and includes an air pump for pumping air from the adsorption filter to the air intake duct to provide for venting air flow particularly when the engine is operating under a high load where little vacuum is generated in the air intake duct.

By providing a pump in a pipe section extending parallel to the tank venting line, the adsorption filter can be regenerated independently of the load state of the internal combustion engine. This parallel arrangement of the pump in a bypass or a side line to the tank venting line facilitates the regeneration of the adsorption filter no matter whether or not the internal combustion engine includes an exhaust gas turbocharger. With the pump, the regeneration flow can be controlled depending on the engine load in such a way that particularly in the upper load range in which the regeneration rate can be highest, there is a large volume flow from the adsorption filter to the air intake duct. In this way, the regeneration can be made dependent on the respective engine operating conditions so that the adsorption filter will never be over-saturated.

In addition, the tank venting system according to the invention can fulfill the requirements of the emission limits expected to become even stricter in the future, since it permits greater adsorption filter regeneration in the full load operating range of the engine, which greatly affects the emission limit values. Furthermore, it can be made sure that, by utilizing a pump, an overflow of the adsorption filter is not possible, so that the occupants of a vehicle are never subjected to noxious fuel vapors.

With the tank venting system according to the invention, it becomes even possible to diagnose the system under various operating conditions utilizing the pump. Furthermore. An onboard-vapor-recovery-system (OVR system) could be utilized, whereby relatively small adsorption filters can be employed. Also, the pump could be utilized for suction removal of the vapors from the tank.

Another advantage of the tank venting system according to the invention is that the tank venting system could be installed, even as an aftermarket option, in vehicles with secondary air injection wherein the secondary air pump, which is already present, could be utilized at the same time for the tank venting system.

In an advantageous embodiment of the invention a line section paralleling the bypass line with the pump includes a check valve. In this way, a return flow of the pump through such line section is prevented.

In another advantageous embodiment of the invention the pump is disposed in a bypass line, which, at one end, branches off the air intake duct and, at its other end after the pump, is coupled with the tank venting line by way of a suction nozzle. In this way, the pump itself handles only clean air from the air intake duct. The regeneration gas from the adsorption filter is sucked in by the suction nozzle as a result of the vacuum generated thereby. Preferably, a regeneration valve is arranged between the suction nozzle and the regeneration valve so that the regeneration valve can be controlled depending on the performance of the pump, whereby it can be prevented that, for example, during compressor operation, the pressure in the adsorption filter becomes excessive.

In another advantageous embodiment of the invention a shut-off valve is arranged in the bypass line branching off the air intake duct upstream of the pump. In this way, the bypass line can be fully closed during idling of the engine so that the engine idle control remains unaffected. Preferably, the shut-off valve is controllable by way of a system control unit.

In an advantageous embodiment of the invention the secondary air pump of an engine secondary air supply system is utilized as the pump providing the air under pressure. In this case, the systems for the regeneration and the secondary air injection can be combined with each other which reduces the amount of components required.

In still another advantageous embodiment of the invention the pump is arranged in a by-pass line of a fresh air supply line leading to the adsorption filter. In this arrangement, the pump can generate a pressure in the adsorption filter by which the regeneration flow can be controlled so as to be proportional to the air mass flow through the engine. In contrast to the embodiment described before, which operates based on vacuum, this embodiment utilizes pressure for controlling the vapor or air flow. Preferably, there is a check valve in the section of the fresh air line, which extends parallel to the bypass line. In this way, it can be made sure that the air discharged by the pump is not returning to the pump via the bypass line and that fuel vapors cannot escape to the environment when the pump is inoperative.

In a further advantageous embodiment of the invention, the tank venting line includes a section which extends parallel to the air intake duct. An impeller is disposed in the air intake duct and in the section of the venting line extending parallel thereto, the two impellers being mounted on a common shaft. This drive arrangement may operate on a principle like an exhaust gas turbocharger: The pumped flow in the parallel line corresponds to the air intake flow driving the wheel in the air intake duct. In this way, the regeneration flow corresponds to the air intake flow, that is, the air flow mass through the engine so that the regeneration flow always corresponds to the engine performance.

Various embodiments of the venting system according to the invention will be described below in greater detail on the basis of the accompanying drawings.

DESCRIPTION OF THE PREFERRED EMBODIMENTS

Figure 1:
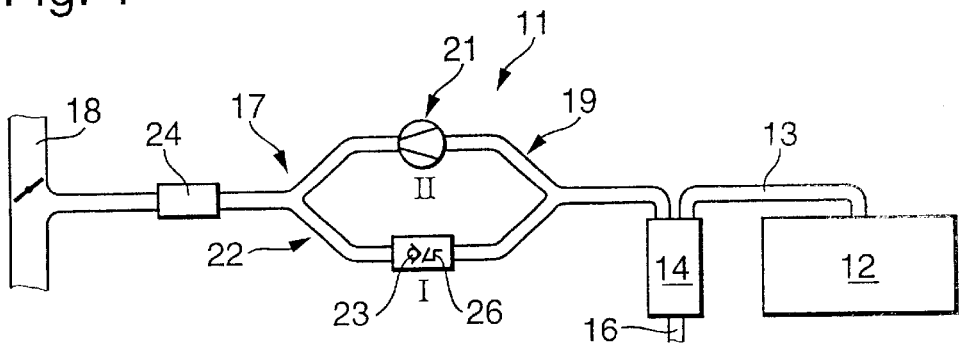
FIG. 1 is a schematic representation of a tank venting system with a pump arranged in a bypass line extending parallel to a tank venting line between an engine intake duct and an adsorption filter.

FIG. 1 is a schematic representation of a tank venting system 11 utilizing a pump and a regeneration valve. A connecting line 13 extends from a tank 12 to an adsorption filter 14, which is for example an activated carbon filter. The purpose of the adsorption filter 14 is to retain fuel escaping from the tank together with air, so that the cleaned air can be discharged to the environment by way of a discharge line 16.

From the adsorption filter 14, a tank venting line 17 leads to an air intake duct 18, which carries fresh air to the internal combustion engine. Downstream of the adsorption filter 14, the tank venting line 17 includes a bypass line 19 in which a pump 21 is arranged.

A parallel pipe section 22, which is part of the tank venting line 17 includes a check valve 23. The bypass line 19 and the pipe section 22 are joined again downstream of the pump 21 and the check valve 23 in a common section of the tank venting line 17, which includes a regeneration valve 24.

In this embodiment, the pump 21 is made to be explosion proof, since it sucks in a regeneration volume from the adsorption filter 14 and conducts it to the engine air intake duct 18. The pump 21 can be controlled in a simple manner by an on/off function. But there may also be provided a ramp-like start up or even a start up with uniformly increasing speed. In this embodiment, it is important to note that the pump needs to operate only in the upper engine load range. As a result, the requirements for the pump control are minimal. In order to prevent gases from returning through the vent pipe section 22, the vent pipe section 22 includes a check valve 23. Furthermore, a shut-off valve 26 is preferably associated with the check valve 23. This permits sudden closing of the regeneration valve 24, when the engine is driven by the vehicle wheels. At this moment, the pump 21 is also shut down, although it will continue to run for a short period, because of its inertia, whereby a pressure is built up in the line between the regeneration valve 24 and the pump 21. The shutoff valve 26 is preferably a pressure limit valve or a controlled valve.

Because of the actively pumping pump 21, this embodiment of the tank venting system can be utilized also in connection with internal combustion engines with a charger.

Figure 2:
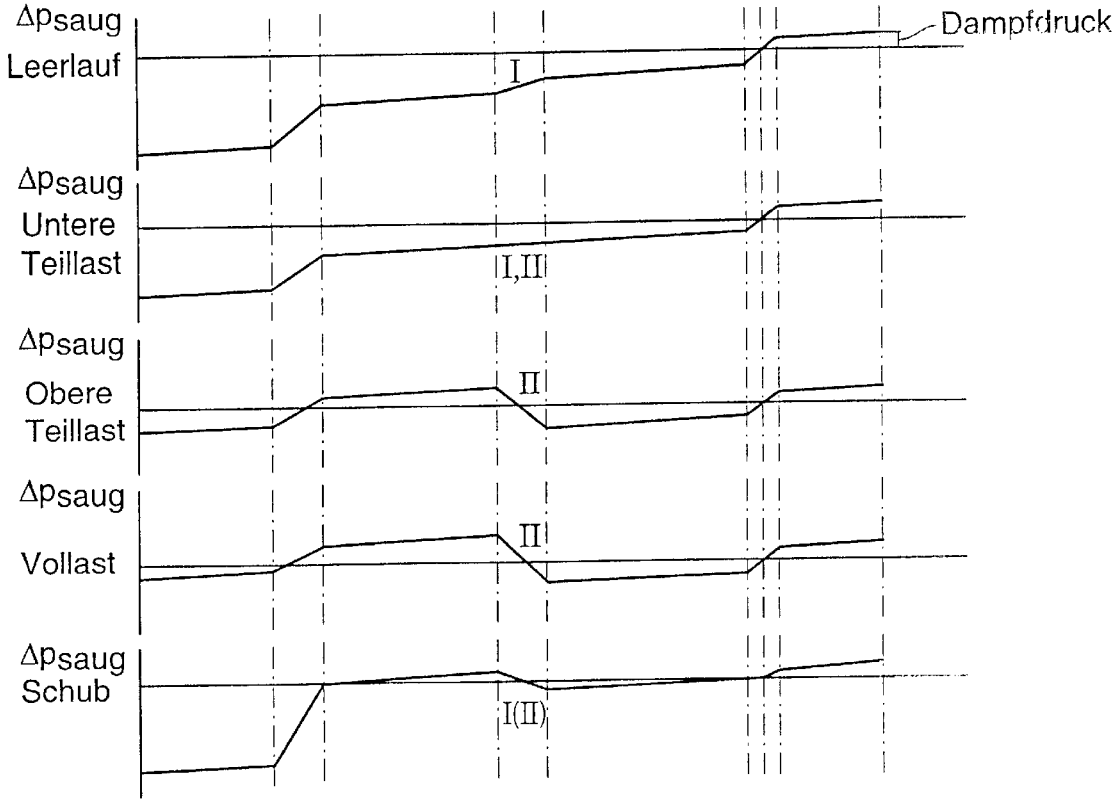
FIG. 2 is a schematic representation of pressure curves of the tank venting system of FIG. 1 in various operating states.

FIG. 2 shows the pressure curves for the tank venting system 11 of FIG. 1 for various operating states. The respective sections on the horizontal axis of the diagram correspond to the components as shown in FIG. 1 positioned above. The curves show the pressure or pressure losses in the various components. For example, at the very right end, where the pressure in the tank connecting line 13 is given, it can be seen that there is a vapor pressure, which is generally present because of the evaporation of fuel to form fuel vapors and which depends on the temperature. Where the pressure curve is below the x-axis, the pressure is below ambient pressure.

Specifically, in the various operating phases, the operating states of the regeneration valve 24, the pump 21 and in the pipe section 22 are described.

During engine idling, the suction pressure difference is very high. In this operating state, the regeneration valve 24 is almost closed and the pump is shut off or idling; the shut off valve 26 in the pipe section 22 is open. In the lower partial load range, the suction pressure differential is sufficient to provide venting air flow without the pump. In this case, the regeneration valve is at an intermediate opening position and the pump is shut off or idling. The shut-off valve 26 in the pipe section 22 remains open. In an upper partial load range, the suction pressure difference in the air intake duct is insufficient whereby the regeneration valve 24 is opened. This provides a signal by which the pump 21 is activated to provide the necessary operating pressure. The shut-off valve 26 in the pipe section 22 is then closed. During full load operation, the suction difference is almost zero. Then the valve 24 is fully opened and the pump 21 is operated at maximum power in order to generate the pressure required for the regeneration. The shut-off valve 26 remains closed. When the engine is driven by the vehicle, there may be a very high suction pressure difference, whereby the regeneration valve is again closed. As a result, the pump 21 is shut off or it is permitted to operate, while the gas is permitted to recirculate to the pump through the pipe section 22 and the shut-off valve 26 is open. However, such recirculation is only possible with a controllable shut-off valve 26.

Figure 3:
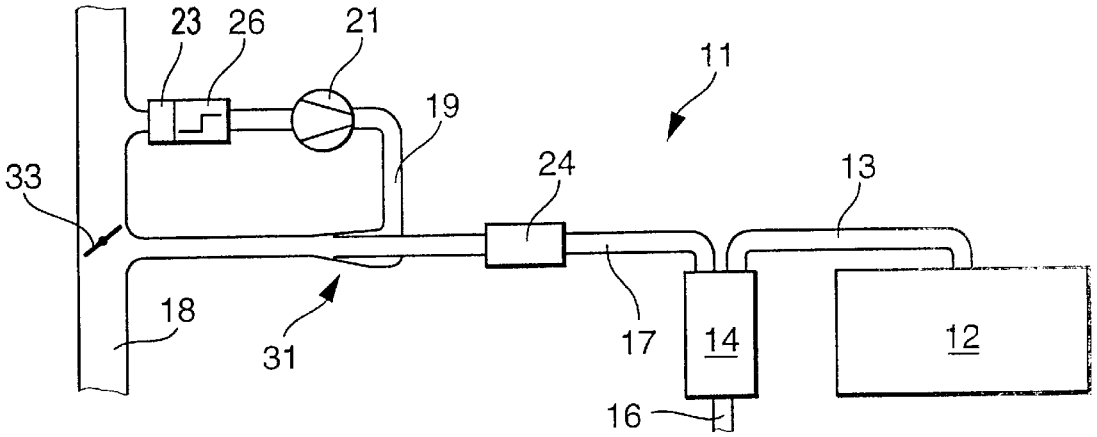
FIG. 3 is a schematic representation of an alternative tank venting system with a pump in a bypass line of a tank vent line which branches off an engine intake duct and leads to the tank venting line which extends between an adsorption filter and the engine intake duct.

FIG. 3 shows another embodiment of the tank venting system 11. In this embodiment, the bypass line 19 branches off the air intake duct 18 and extends to the tank venting line 17 by way of a suction nozzle 31.

Between the pump 21 and the air intake duct 18, there is a shut-off valve 26; between the suction nozzle 31 and the adsorption filter 14, there is the regeneration valve 24.

In this arrangement, only pure air is supplied to the pump 21 from the air intake duct and the pump 21 supplies the air to the tank venting line 17 by way of the suction nozzle 31. In accordance with the venturi principle, with the regeneration valve 24 open, the desired regeneration air volume can be pumped, by the vacuum generated in the suction nozzle 31, out of the adsorption filter 14 and supplied to the air intake duct 18. By taking in only pure air, the pump 21 may be of a simple design particularly with regard to sealing. The air taken out of the air intake duct 18 is measured by an air flow meter 32 since otherwise an uncontrolled amount of air could be supplied to the engine which might detrimentally affect the formation of the proper fuel/air mixture and the combustion in the engine. During engine idle, the closing of the shut-off valve 26 makes sure that the bypass line 19 to the throttle valve 33 in the air intake duct 18 is closed in order to avoid that the idle control is affected thereby. This can be achieved for example by using a controllable check valve 23/26.

Figure 4:
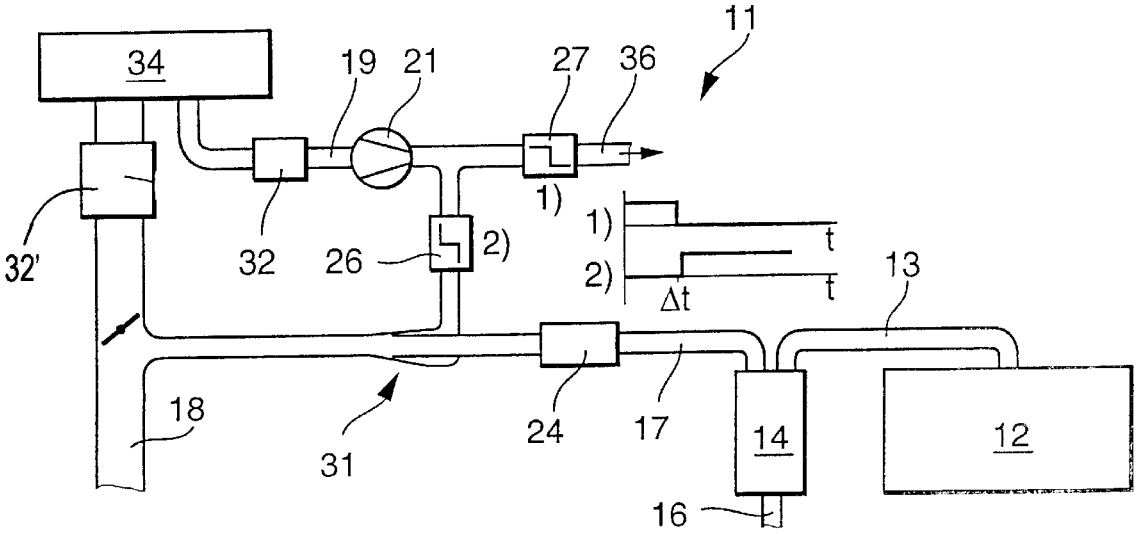
FIG. 4 is a schematic representation of an arrangement combining the tank venting system of FIG. 3 with a secondary air injection system.

FIG. 4 shows a tank venting system 11 as shown in FIG. 3 in combination with a secondary air injection system. In contrast to FIG. 3, the shut-off valve 26 is disposed in the bypass line 19 downstream of the pump 21. The pump 21 serves at the same time as the secondary air injection pump taking in air, which is cleaned by an air filter 34 and which is measured by an air flow meter 32. Another air flow meter 32' is arranged in the air intake duct 18, which is also in communication with the air filter 34.

Downstream of the pump 21, a line 36 branches off the bypass line 19 and leads to the exhaust system (not shown).

The shut-off valve 26 of the bypass line 19 and a shut-off valve 27 in the line 36 operate in accordance with the time diagram also given in FIG. 4. It indicates that during a cold start, the pump 21 delivers air to the exhaust system. At this point, the shut-off valve 26 is closed and the shut-off valve 27 is opened. With this arrangement, it is made sure that pure air and not unburnt fuel vapors are supplied to the exhaust system. Such an arrangement is possible since no regeneration is provided for during cold start operation of the engine.

When the cold start operating phase of the engine is over, the shut-off valve 27 is closed and the shut-off valve 26 is opened. The shut-off valve 26 is controlled depending on the subsequent operating conditions as it is described for the various operating phases in connection with FIG. 3.

Figure 5:
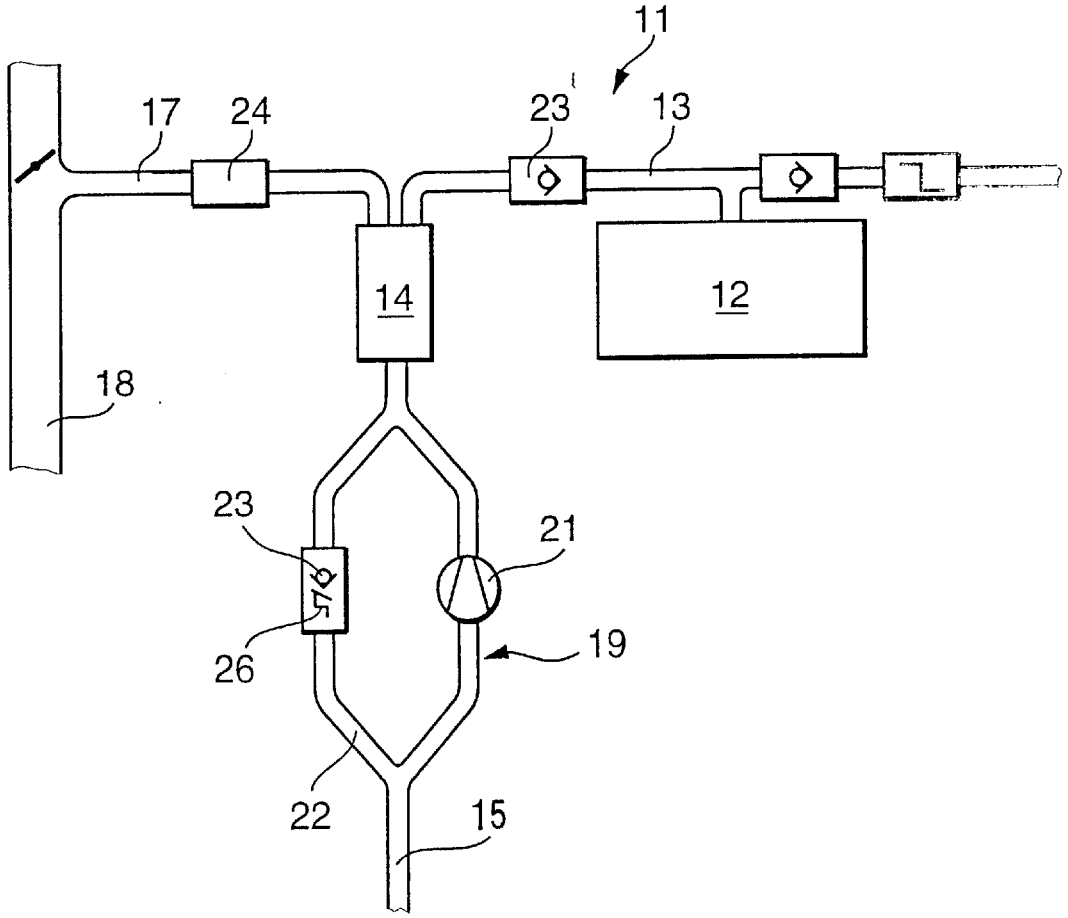
FIG. 5 is a schematic representation of an alternative tank venting system with a pump arranged in a bypass line and a check valve arranged in the vent line section bypassed by the bypass line.

FIG. 5 shows another alternative embodiment of a tank venting system 11. Like in the embodiments of FIG. 3, and FIG. 4, in this embodiment, a pump 21 is provided which pumps fresh air. As shown, a fresh air line 15 which leads to the adsorption filter 14 includes a bypass line 19 with a pump 21. Parallel to the bypass line 19, there is a pipe section 22, which includes the check valve 23. Another check valve 23' is disposed in the tank connecting line 13 between the adsorption filter 14 and the tank 12 such that the fuel cannot be forced back into the tank 12 or, by way of the tank filler neck, into the environment. This also prevents the tank from being pressurized.

This embodiment may also be used in combination with secondary air injection, wherein the pump 21 is used at the same time as secondary air pump.

Figure 6:
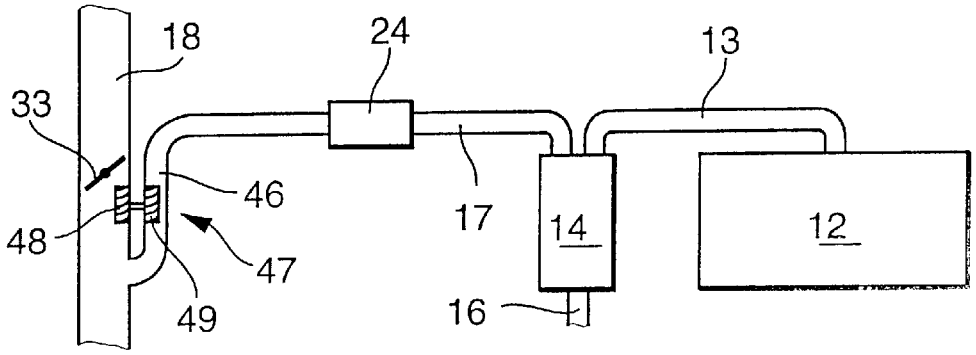
FIG. 6 is a schematic representation of another alternative embodiment wherein the vent line has a section extending parallel to the air intake line with a pump and a pump drive disposed therebetween.

FIG. 6 shows another alternative embodiment of a tank venting system 11. In this arrangement, there is provided a tank venting line 17, which includes, downstream of the regeneration valve 24, a line section 46 which extends parallel to the air intake duct 18. Between the two parallel sections of the venting line 17 and the air intake duct 18, there is a drive arrangement 47 similar in the operation to an exhaust gas turbocharger. The air intake duct 18 includes a turbine 48 and the line section 46 includes a compressor 49, which is driven by the turbine 48. In this way, the pump volume that is the regeneration air flow depends on the air mass flow through the engine. As a result, the regeneration air flow is proportional to the air mass flow through the engine.

The drive arrangement 47 can be arranged in the air intake duct 18 upstream or downstream of the throttle valve 33. Preferably, it is arranged close to the engine because of the losses in the air intake duct 18.

This alternative arrangement has the advantage that no seal problems will occur since the drive arrangement 47 has no connections to the ambient. In addition, the pumped flow is automatically controlled depending on the air mass flow through the engine, which is determined by the engine operating phases.

Figure 7:
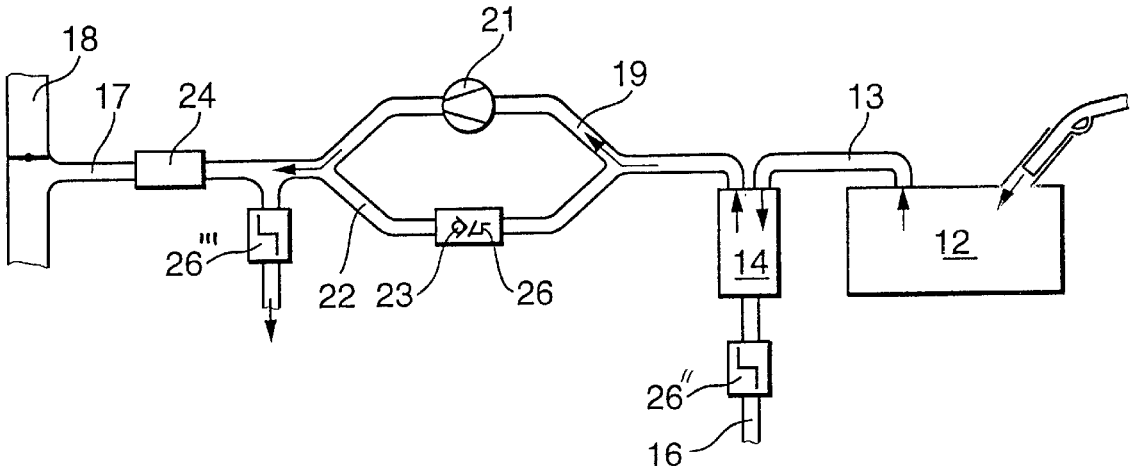
FIG. 7 is a schematic representation of a tank venting system according to FIG. 1, which is integrated into an onboard vapor recovery system.

FIG. 7 shows a tank venting system according to FIGS. 1 and 2 utilized in an OVR system (On-board Vapor Recovery system). In this system, also the vapors generated when fuel is filled into the tank must be retained. For this purpose, the tank venting system 11 of FIG. 1 is modified by providing in the discharge air line 16 a shut-off valve 26" and another shut-off valve 26"' upstream of the regeneration valve 24 and downstream of the pump 21. Then, during filling of the tank with fuel, the pump 21 can suck gases out of the tank 12 by way of the adsorption filter 14. The shut-off valve 26" in the discharge air line 16 is then closed. Consequently, the fuel vapors can be adsorbed in the adsorption filter 14 and the vapor-free air can be discharged by way of the shut-off valve 26, which is open in this phase. It is made sure in this way that the tank venting system is uncoupled from the air intake duct 18 and no fuel vapors can reach the air intake duct 18, when the adsorption filter 14 is full.

With such an arrangement, the otherwise necessary sealing of the fuel filler nozzle can be eliminated. The adsorption filter 14 of such an OVR system is sufficiently large that it can accommodate fuel vapors for all possible circumstances so that no fuel is discharged into the environment.

The various embodiments of the tank venting system 11 all have in common that a pump 21 is arranged in a by-pass line 19 for the flushing of the adsorption filter 14 permitting its regeneration. This pump 21 may be a suction pump or a pressure pump. Other alternative embodiments and arrangements utilizing this principle of operation are conceivable.

What is claimed is:

1. A fuel tank venting system for a vehicle with an internal combustion engine having an air intake duct, said system including a tank, an adsorption filter in communication with said tank by a connecting line, a venting line extending between said adsorption filter and said air intake duct and including a regeneration valve, and a bypass line disposed in parallel with a section of said venting line and including a pump for pumping air from said adsorption filter to said air intake duct, and said section of said venting line which is bypassed by said bypass line including a check valve.

2. A fuel tank venting system according to claim 1, wherein a regeneration valve is arranged in said venting line between said air intake duct and the jointure of said bypass line with said venting line.

3. A fuel tank venting system according to claim 1, wherein said bypass line extends between said air intake duct and a suction nozzle disposed in said venting line, said pump being disposed in said bypass line for operating said suction nozzle to draw gas out of said adsorption filter.

4. A fuel tank venting system according to claim 1, wherein said pump is arranged in a bypass line extending parallel to a fresh air line section leading to said adsorption filter.

5. A fuel tank venting system for a vehicle with an internal combustion engine having an air intake duct, said system including a tank, an adsorption filter in communication with said tank by a connecting line, a venting line extending between said adsorption filter and said air intake duct and including a regeneration valve, a suction nozzle disposed in said venting line and a bypass line connected to said air intake duct and extending to said suction nozzle, and a pump disposed in said bypass line for operating said suction nozzle to draw gas out of said adsorption filter.

6. A fuel tank venting system according to claim 5, wherein a regeneration valve is arranged between said suction nozzle and said adsorption filter.

7. A fuel tank venting system according to claim 5, wherein a shut-off valve is arranged in said bypass line upstream of said pump.

8. A fuel tank venting system according to claim 5, wherein a secondary air pump of an air injection system is used as the pump in said venting system.

9. A fuel tank venting system for a vehicle with an internal combustion engine having an air intake duct, said system including a tank, an adsorption filter in communication with said tank by a connecting line, a venting line extending between said adsorption filter and said air intake duct and including a regeneration valve, said venting line having a line section extending parallel to said air intake duct and a drive arrangement disposed between said line section and said air intake duct.

10. A fuel tank venting system according to claim 9, wherein said drive arrangement includes a turbine arranged in the air intake duct and a compressor arranged in said line section and being operated by said turbine so as to generate in said line section an air flow proportional to the air flow volume through said air intake duct.

* * * * *